US007216494B2

(12) United States Patent
Thurman

(10) Patent No.: US 7,216,494 B2
(45) Date of Patent: May 15, 2007

(54) SUPERMARKET REFRIGERATION SYSTEM AND ASSOCIATED METHODS

(76) Inventor: Matt Alvin Thurman, 10350 Lehman Rd., Orlando, FL (US) 32825

( * ) Notice: Subject to any disclaimer, the term of this patent is extended or adjusted under 35 U.S.C. 154(b) by 108 days.

(21) Appl. No.: 10/962,976

(22) Filed: Oct. 12, 2004

(65) Prior Publication Data

US 2005/0097918 A1 May 12, 2005

Related U.S. Application Data

(60) Provisional application No. 60/513,713, filed on Oct. 23, 2003, provisional application No. 60/510,303, filed on Oct. 10, 2003.

(51) Int. Cl.
*F25B 43/02* (2006.01)

(52) U.S. Cl. ..... 62/84; 62/256; 62/468

(58) Field of Classification Search ..... 62/246–256, 62/507–508, 468–469, 84
See application file for complete search history.

(56) References Cited

U.S. PATENT DOCUMENTS

| | | | | |
|---|---|---|---|---|
| 3,580,006 A | | 5/1971 | Quick | 62/196 |
| 4,318,278 A | * | 3/1982 | Olson et al. | 62/347 |
| 4,430,866 A | * | 2/1984 | Willitts | 62/196.4 |
| 4,484,450 A | * | 11/1984 | Dolce | 62/89 |
| 4,621,505 A | * | 11/1986 | Ares et al. | 62/509 |
| 4,748,820 A | | 6/1988 | Shaw | 62/175 |
| 4,813,239 A | | 3/1989 | Olson | 62/81 |
| 4,945,733 A | | 8/1990 | LaBrecque | 62/278 |
| 4,979,371 A | * | 12/1990 | Larson | 62/81 |
| 5,009,080 A | * | 4/1991 | Naganuma et al. | 62/256 |
| 5,042,268 A | | 8/1991 | LaBrecque | 62/278 |
| 5,335,508 A | | 8/1994 | Tippmann | 62/129 |
| 5,440,894 A | | 8/1995 | Schaeffer et al. | 62/203 |
| 5,743,102 A | | 4/1998 | Thomas et al. | 62/185 |
| 5,921,092 A | | 7/1999 | Behr et al. | 62/81 |
| 6,067,482 A | * | 5/2000 | Shapiro | 700/286 |
| 6,131,401 A | | 10/2000 | Ueno et al. | 62/175 |
| 6,223,554 B1 | * | 5/2001 | Adachi | 62/468 |
| 6,272,870 B1 | * | 8/2001 | Schaeffer | 62/205 |
| 6,408,635 B1 | | 6/2002 | Pham et al. | 62/222 |
| 6,578,376 B2 | | 6/2003 | Thurman | 62/246 |
| 6,588,221 B1 | | 7/2003 | Gregory | 62/81 |
| 6,615,593 B2 | | 9/2003 | Thurman | 62/89 |

* cited by examiner

*Primary Examiner*—William E. Tapolcai
(74) *Attorney, Agent, or Firm*—Allen, Dyer, Doppelt, Milbrath & Gilchrist, P.A.

(57) ABSTRACT

A supermarket refrigeration system may include a plurality of supermarket refrigeration cases, each including an evaporator and an associated compressor connected downstream therefrom. A common condenser is connected downstream from the compressors, and a receiver is connected downstream from the common condenser and upstream from the evaporators. A liquid header extends throughout the supermarket and connects the receiver and the evaporators. A discharge header extends throughout the supermarket and connects the compressors to the common condenser. An oil-bearing refrigerant mixture may circulate through a refrigerant circulation path to lubricate the compressors without undesired pooling and without an oil separator. The system may further include a selectively operable defrost circuit which uses hot refrigerant mixture for defrosting.

18 Claims, 3 Drawing Sheets

10

SUPERMARKET
18
38
20
19
32a
32b
31d
31c
31b
31a
17b
17a
16b
16a
LIQUID HEADER
DISCHARGE HEADER
30
28
22b
22a
REFRIGERATION CASE
REFRIGERATION CASE
52b
52a
68b
68a
P
P
70b
70a
50b
50a
46b
46a
14b
14a
56b
56a
HOT DEFROST GAS
HOT DEFROST GAS
36b
36a
42b
42a
48b
48a
40b
40a
59b
59a
12b
12a

SUPERMARKET REFRIGERATION SYSTEM AND ASSOCIATED METHODS

RELATED APPLICATION

This application is based upon prior filed now abandoned provisional application Ser. No. 60/510,303 filed Oct. 10, 2003, and provisional application Ser. No. 60/513,713 filed Oct. 23, 2003 the entire disclosures of which are incorporated herein by reference in their entirety.

FIELD OF THE INVENTION

The invention relates to the field of refrigeration, and, more particularly to a refrigeration system and associated refrigeration methods for a supermarket.

BACKGROUND OF THE INVENTION

A typical supermarket includes a rack type refrigeration system wherein a plurality of individual refrigeration cases are placed throughout the supermarket. These cases display and store the supermarket goods requiring cold temperatures to prevent spoilage and/or melting. Each case may include a housing that also contains an expansion valve and evaporator. As the liquid refrigerant passes through the expansion valve, it cools and passes through the evaporator to extract heat therefrom. Fans blow air through the evaporator to extract heat from the air so that a flow of cool air is generated and directed toward the goods to be kept cool.

Each evaporator receives a flow of liquid refrigerant from a central equipment room that houses common refrigeration equipment. The refrigerant gas output from each evaporator is supplied to the input of a common compressor. A common condenser is connected downstream from the compressor to cool the heated compressed refrigerant from the compressor. A common high pressure receiver is connected downstream from the condenser to collect liquid refrigerant. The liquid refrigerant from the receiver is then supplied back to the evaporators.

This conventional type of supermarket refrigeration system requires considerable copper piping to supply the liquid refrigerant to the evaporators, and to return the refrigerant gas back to the compressor. Indeed, a typical supermarket may contain about eight miles of copper piping. Unfortunately, the piping for the return refrigerant gas may still be relatively cool and therefore cause moisture condensation along its outer surface. This moisture is typically collected, such as using drip pans, to avoid wet areas in the supermarket. These pipes are also of a relatively large diameter, for example, about 1⅝ inches. In other words, a considerable investment in piping, maintenance, and moisture control is needed for the conventional supermarket refrigeration system.

Another type of supermarket refrigeration uses self-contained refrigeration cases that include the expansion valve, evaporator, compressor and condenser. These do not require the extensive piping as described above for the rack type system. However, the heat released from the condenser into the interior of the supermarket needs to be removed by the supermarket air conditioning system.

Yet another supermarket refrigeration system is described in U.S. Pat. No. 5,440,894 to Schaeffer et al. The patent discloses a plurality of refrigeration cases connected to a distribution manifold and return manifold. The distribution manifold is connected to evaporators in the refrigeration cases. The evaporators are connected to a common suction header that connects to a number of multiplexed compressors that are connected to a condenser rack.

U.S. Pat. No. 4,748,820 to Shaw discloses a refrigeration system for multiple refrigeration cases in which each refrigeration case has a low-stage booster compressor and an evaporator. The low-stage booster compressor is connected to a manifold that is connected to high-stage compressors. The high-stage compressors are connected to an oil separator and the oil separator is connected to a condenser. The condenser is connected to a receiver that is connected to a liquid distribution manifold that is connected to the evaporator.

U.S. Pat. No. 5,042,268 to LaBrecque discloses a refrigeration system that operates evaporators in both moderate and low refrigerated cases in which respective compressors are associated with each type of evaporator. The compressors are connected downstream of the evaporators and upstream of the receiver. In addition, all the compressors are lubricated by an oil separator using dedicated oil lines.

Unfortunately, current supermarket refrigeration systems may be relatively complicated and expensive, especially where moisture control and/or separate oil lines are used.

SUMMARY OF THE INVENTION

In view of the foregoing background, it is therefore an object of the present invention to provide a supermarket refrigeration system that is simpler and less expensive to install and operate.

This and other objects, features, and advantages in accordance with the present invention are provided by a supermarket refrigeration system that includes a plurality of supermarket refrigeration cases that can contain refrigerated goods therein. Each supermarket refrigeration case may include an evaporator and an associated compressor connected downstream therefrom. The system may further include a common condenser connected downstream from the compressors. A receiver may be connected downstream from the common condenser and upstream from the evaporators. A liquid header may extend throughout the supermarket and connect the receiver and evaporators. Similarly, a discharge header may extend throughout the supermarket to connect the compressors to the common condenser. An oil-bearing refrigerant mixture may circulate through a refrigerant circulation path defined by the evaporators, associated compressors, common condenser, receiver, liquid header, and discharge header. Moreover, the oil-bearing refrigerant mixture advantageously lubricates the compressors without undesired pooling and without an oil separator in the refrigerant circulation path. Accordingly, the present invention is simpler and less expensive to install and operate than supermarket refrigeration systems found today, especially those requiring extensive moisture control and/or separate oil lines.

The supermarket refrigeration system may include a common condenser located external from the supermarket. Each evaporator and associated compressor in the system may have matched capacities. In some embodiments, each supermarket refrigeration case may further include an insulated enclosure surrounding the compressor. Unused expansion drop connections may also be provided along the liquid header and the discharge header.

In accordance with another advantageous aspect of the invention, each case may further include a selectively operable defrost circuit to provide hot refrigerant mixture for defrosting the evaporator. The supermarket refrigeration system may further include a refrigerant defrost pump connected between the evaporator and the liquid header that operates with the defrost circuit.

The common condenser of the system may include a condenser heat exchanger and a plurality of selectively operable condenser fans associated therewith. In addition, the liquid header and the discharge header of the system may each comprise copper lines.

Another aspect of the invention relates to a method for operating the supermarket refrigeration system as described above. The method may include circulating the oil-bearing refrigerant mixture through a refrigerant circulation path defined by the evaporators, compressors, common condenser, receiver, liquid header, and discharge header so that the oil-bearing refrigerant mixture lubricates the compressors without undesired pooling and without an oil separator in the refrigerant circulation path.

Another aspect of the invention is directed to defrosting. The method may include selectively operating the defrost circuit of a supermarket refrigeration case to use hot refrigerant mixture for defrosting.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
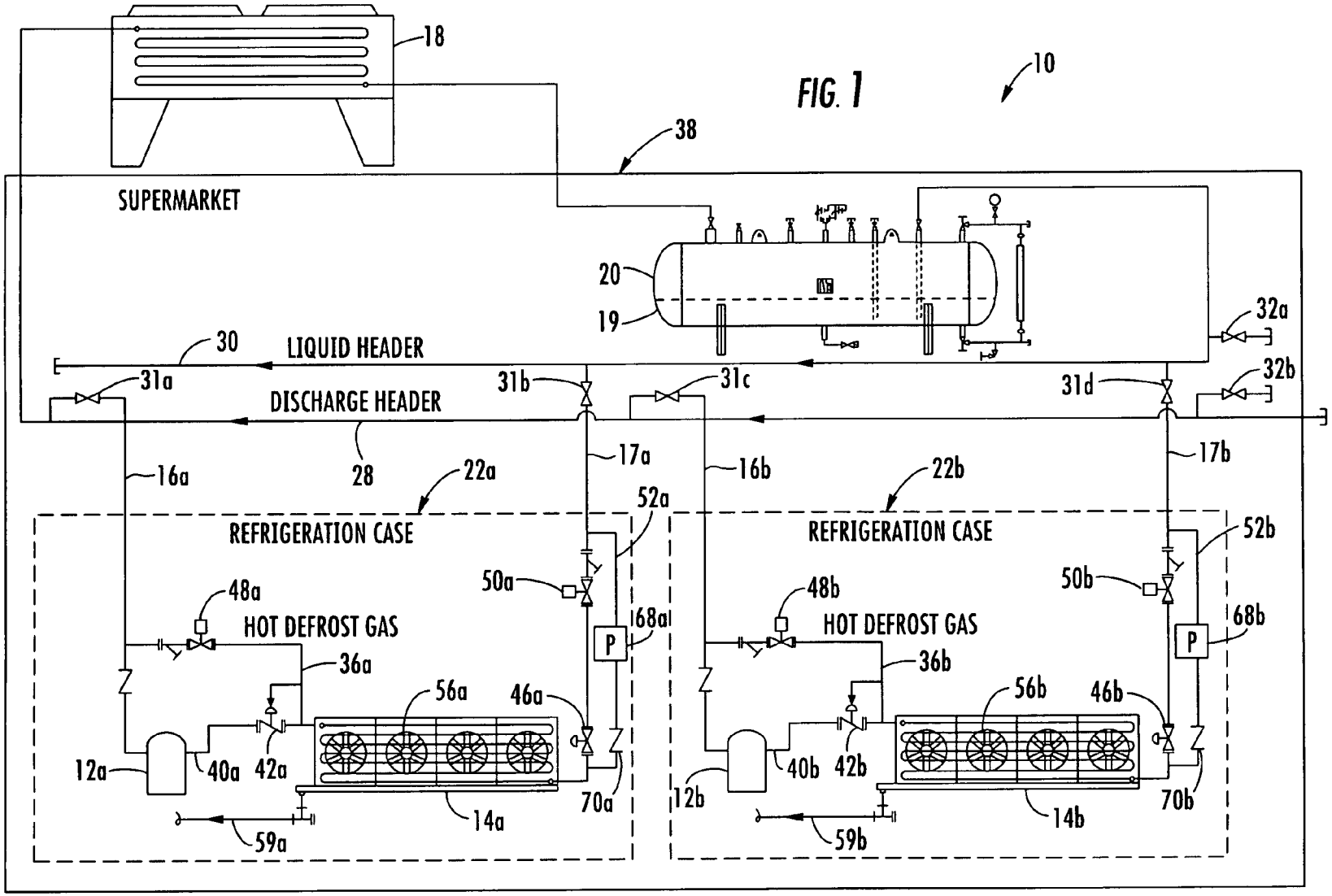
FIG. 1 is a schematic diagram of a supermarket refrigeration system in accordance with the present invention.

Referring now initially to FIG. 1, the basic components and interconnections of a supermarket refrigeration system 10 in accordance with the invention are now described. The supermarket refrigeration system 10 illustratively includes a plurality of supermarket refrigeration cases 22*a*, 22*b*, which can contain refrigerated goods therein. Each supermarket refrigeration case 22*a*, 22*b* includes a respective evaporator 14*a*, 14*b* and an associated respective compressor 12*a*, 12*b* connected downstream therefrom. Although only two refrigeration cases 22*a*, 22*b* are shown in the illustrated system 10, those of skill in the art will recognize that more than two such cases would be used in a typical supermarket 38.

The illustrated supermarket refrigeration system 10 further includes a common condenser 18 connected downstream from the compressors 12*a*, 12*b*. A receiver 20 is connected downstream from the common condenser 18 and upstream from the evaporators 14*a*, 14*b*. A liquid header 30 extends throughout the supermarket 38 and connects the receiver 20 and evaporators 14*a*, 14*b*. A discharge header 28 extends throughout the supermarket 38 to connect the compressors 12*a*, 12*b* to the common condenser 18.

Moreover, an oil-bearing refrigerant mixture 19 circulates through a refrigerant circulation path defined by the evaporators 14*a*, 14*b*, associated compressors 12*a*, 12*b*, common condenser 18, receiver 20, liquid header 30, and discharge header 28. The oil-bearing refrigerant mixture 19 lubricates the compressors 12*a*, 12*b* without undesired pooling and without an oil separator in the refrigerant circulation path. Accordingly, the system 10 is simpler and less expensive to install and operate than other supermarket refrigeration systems.

The supermarket refrigeration system 10 illustratively includes the common condenser 18 located external from the supermarket 38. Each evaporator 14*a*, 14*b* and associated compressor 12*a*, 12*b* can have matched capacities. Unused expansion drop connections 32*a*, 32*b* may be provided along the liquid header 30 and discharge header 28.

In accordance with another advantageous aspect of the invention, each case 22*a*, 22*b* may further include a selectively operable defrost circuit 36*a*, 36*b* to provide hot oil-bearing refrigerant mixture 19 for defrosting. Each refrigeration case may also include a refrigerant defrost pump 68*a*, 68*b* connected between the respective evaporators 14*a*, 14*b* and the liquid header 30.

The common condenser 18 may include a condenser heat exchanger 54 and a plurality of selectively operable condenser fans 56 associated therewith. In addition, the liquid header 30 and the discharge header 28 of refrigeration system 10 may each comprise copper lines as will be appreciated by those skilled in the art.

A method aspect of the invention is for operating the supermarket refrigeration system 10. The method may include circulating an oil-bearing refrigerant mixture 19 through a refrigerant circulation path defined by the evaporators 14*a*, 14*b*, compressors 12*a*, 12*b*, common condenser 18, receiver 20, liquid header 30, and discharge header 28. The oil-bearing refrigerant mixture 19 may lubricate the compressors 12*a*, 12*b* without undesired pooling and without an oil separator in the refrigerant circulation path.

Another aspect of the invention is a method for defrosting a refrigeration case 22*a*, 22*b*. The method includes selectively operating a defrost circuit 36*a*, 36*b* to use hot refrigerant mixture 19 for defrosting the respective case 22*a*, 22*b*.

In supermarket refrigeration system 10, a respective compressor 12*a*, 12*b* is provided at each refrigeration case 22*a*, 22*b* and is connected adjacent to its evaporator 14*a*, 14*b*. The connection illustratively comprises a suction line 40*a*, 40*b* and a check valve 42*a*, 42*b*. The check valve 42*a*, 42*b* can be gas powered.

Each compressor 12*a*, 12*b* can be a highly efficient state-of-the-art compressor whose capacity is matched to the capacity of evaporator 14*a*, 14*b*. The matched capacity of compressor 12*a*, 12*b* and evaporator 14*a*, 14*b* reduces the suction line 40*a*, 40*b* inefficiencies brought on by suction line control valves.

Another advantage of locating the compressor 12*a*, 12*b* and evaporator 14*a*, 14*b* close together is that such a configuration can significantly reduce the suction line 40*a*, 40*b* pressure losses due to long runs of piping to increase the efficiency of refrigeration system 10. As a result, the piping from the individual compressors 12*a*, 12*b* can be considerably smaller in diameter than a traditional supermarket refrigeration system.

In the illustrated refrigeration system 10, the discharged oil-bearing refrigerant mixture 19 from each compressor 12*a*, 12*b* is relatively warm thereby substantially reducing the amount of condensation found in traditional supermarket refrigeration system. Each compressor 12*a*, 12*b* is connected to the common condenser 18 by the discharge header 28.

In a preferred embodiment, the common condenser 18 is located outside the air-conditioned structure of supermarket 38 such as on the roof, behind the building, or in a mechanical room. Removing the condenser 18 from the air-conditioned interior of the supermarket 38 eliminates the heat dissipated by the condenser 18 from heating the air-conditioned space of the supermarket 38. Therefore, the air conditioning system of supermarket 38 does not need to be sized to carry away the heat generated by common condenser 18 as when individual self-contained refrigeration cases are used.

The common condenser 18 receives heated oil-bearing refrigerant mixture 19 from each compressor 12*a*, 12*b* and cools it. The common condenser 18 is connected to the receiver 20 and the receiver collects the cooled oil-bearing refrigerant mixture 19 as will be appreciated by those skilled in the art.

Figure 2:
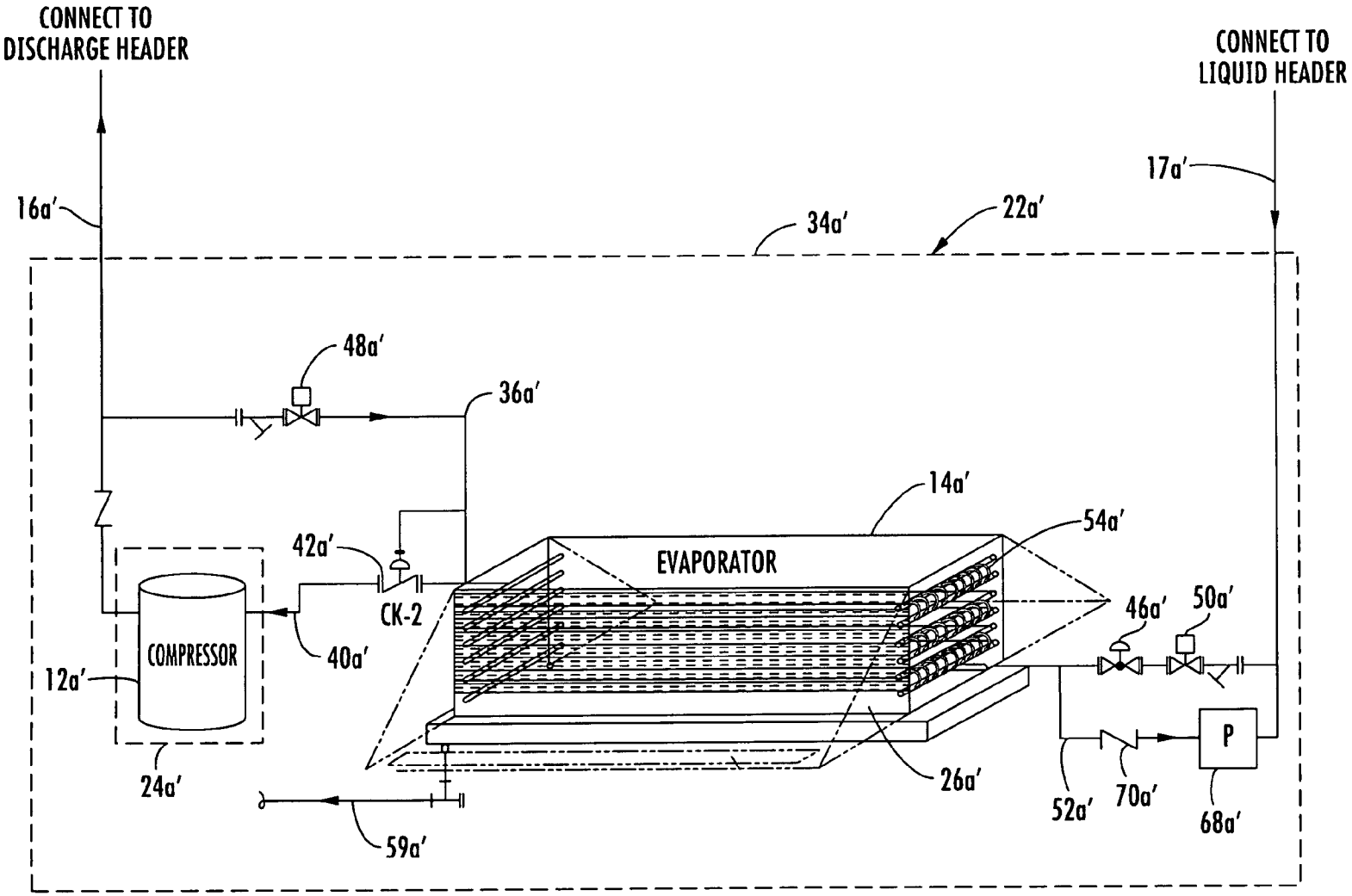
FIG. 2 is a schematic diagram of an alternative embodiment of a supermarket refrigeration case as may be used in the system shown in FIG. 1.

Referring now additionally to FIG. 2, another embodiment of a supermarket refrigeration case 22*a*' is now described. In this embodiment, the compressor 12*a*' and evaporator 14*a*' are both within one housing 34*a*' that may be insulated. Respective lines 17*a*', 16*a*' to the liquid header and discharge header penetrate the housing 34*a*' and connect to the high pressure side of refrigeration system 10. The compressor 12*a*' is also surrounded by an insulated enclosure 24*a*' in this illustrated embodiment. The refrigerant suction line 40*a*' is very short and is inside the housing 34*a*', thus eliminating the need for long runs of exposed suction lines. As a result, the use of drain pans for catching condensate may be reduced.

Accordingly, the use of ¾" and 1" Armaflex insulation may be eliminated due to the location and reduction in size of suction line 40*a*'. Maintenance of saturated Armaflex, the liability and health department issues associated with the latter may be reduced. An optional hood 26*a*' is also shown in the illustrated embodiment to control the airflow around the evaporator 14*a*'.

The short suction lines 40*a*, 40*b*, 40*a*' of the refrigeration system 10 also eliminate the need for an oil separator that is required by traditional supermarket refrigeration rack systems. Thus, the refrigeration system 10 does not need an oil separator whether refrigeration system 10 includes low temperature refrigeration cases, moderate temperature refrigeration cases or a combination of the two.

Figure 3:
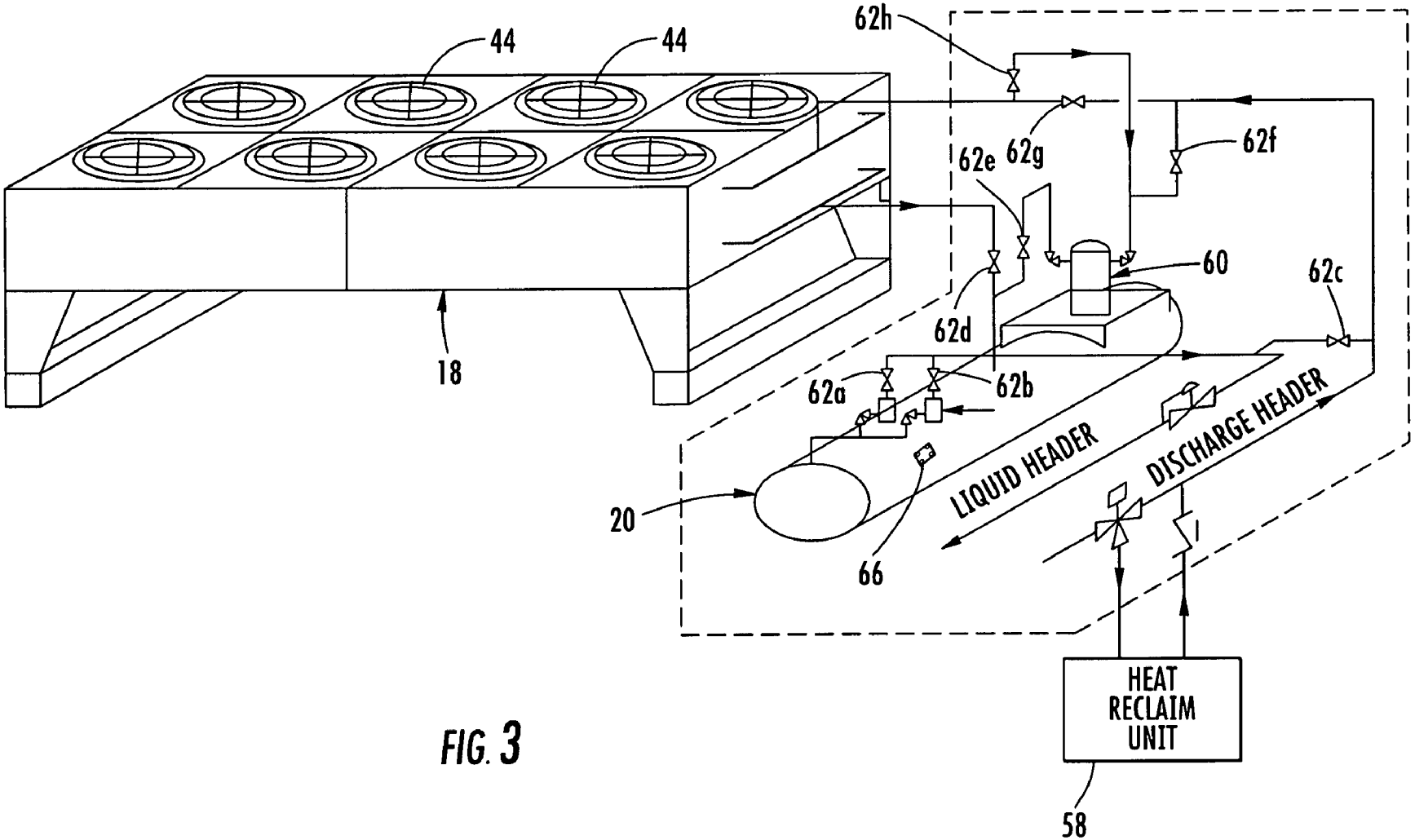
FIG. 3 is a schematic diagram of an alternative embodiment of a condenser and receiver as may be used in the system shown in FIG. 1.

Referring again to FIG. 1 and additionally to FIG. 3, the high pressure side of refrigeration system 10 includes the common condenser 18, receiver 20, pressure vessels, piping, and instrumentation specifically designed for this application. The common condenser 18 can be sized to accommodate all refrigeration cases 22*a*, 22*b* in the refrigeration system 10. Further, the capacity of condenser 18 can be controlled to meet load conditions by cycling the condenser fans 44 (FIG. 3). A common condenser 18 with multiple condenser fans 44 is an energy efficient way to condense oil-bearing refrigerant mixture 19.

The receiver 20 is connected downstream of the common condenser 18. The flow of oil-bearing refrigerant mixture 19 to the receiver 20 is controlled by valves 62*a*–62*h* as will be appreciated by those skilled in the art. The receiver 20 may have associated therewith the illustrated pump-out compressor 60, filter drier 64, and liquid level gauge 66.

The refrigeration system 10 may include one discharge header 28 and one liquid header 30 to serve all compressors 12*a*, 12*b* and evaporators 14*a*, 14*b*. The efficiency of the compressors 12*a*, 12*b* will not be penalized by discharging into a properly sized discharge header 28.

As discussed briefly above, the discharge header 28 and the liquid header 30 can have expansion drop connections 32 by which additional equipment can easily be added. Accordingly, the discharge header 28 and liquid header 30 can also be evacuated and a new connection made at quick connect valves 31*a*–31*d* where additional refrigeration cases are to be located in refrigeration system 10. Accordingly, the cost of relocating cases, adding cases, or remodels in general throughout the life of the supermarket 38 will be reduced.

During the refrigeration cycle when each refrigeration case 22*a*, 22*b* calls for cooling, liquid oil-bearing refrigerant mixture 19 flows from the liquid header 30 and into liquid supply lines 17*a*, 17*b*. The liquid oil-bearing refrigerant mixture 19 flows through the liquid supply lines 17*a*, 17*b* and is controlled by the liquid solenoid valves 50*a*, 50*b*.

Liquid oil-bearing refrigerant mixture 19 flows through the thermal expansion valve 46*a*, 46*b*, and into the coil of evaporator 14*a*, 14*b*. The evaporator fans 56*a*, 56*b* and compressor 12*a*, 12*b* are energized and the refrigeration system 10 produces cooling. The compressor 12 discharges heated oil-bearing refrigerant mixture 19 through discharge lines 16*a*, 16*b* to the discharge header 28. This high pressure, high temperature oil-bearing refrigerant mixture 19 flows in the discharge header 28 to the common condenser 18.

The oil-bearing refrigerant mixture 19 is condensed and the heat is dissipated. The oil-bearing refrigerant mixture 19, now a liquid, is stored in the high pressure receiver 20 awaiting demand from the refrigeration cases 22*a*, 22*b*.

Returning again briefly to FIG. 2, when the refrigeration temperatures are above freezing, the evaporator coils 54*a*' remain clean by off cycle, or timed off, air defrost. In the off cycle mode, temperatures are satisfied, and liquid flow to the evaporator 14*a*' is stopped by the liquid solenoid valve 50*a*' and the compressor 12*a*' lowers the pressure and automatically shuts off. The air temperature inside refrigeration case 22*a*' is warm enough to defrost the evaporator coils 54*a*' within a specified time frame.

Where refrigeration temperatures are below freezing, the evaporator coils 54*a*' are defrosted by the defrost circuit 36*a*'. The defrost circuit 36*a*' uses hot gas, which is heated oil-bearing refrigerant mixture 19, circulating in the discharge header 28.

The control system initiates the defrost cycle. The liquid solenoid valve 50*a*' stops the oil-bearing refrigerant mixture 19 from flowing to the evaporator 14*a*'. The compressor 12*a*' pumps down and shuts off and evaporator fans 56*a* (FIG. 1) shut off. The hot gas solenoid valve 48*a*' opens thereby allowing hot oil-bearing refrigerant mixture 19 to flow from discharge header 28 into evaporator coil 54*a*'. The hot oil-bearing refrigerant mixture 19 is generated by the other refrigerated cases connected to the discharge header 28.

The flow of hot oil-bearing refrigerant mixture 19 is created by a refrigerant defrost pump 68*a*' on the dump line 52*a*'. Also on the dump line 52*a*' is a check valve 70*a*'. The heat from the oil-bearing refrigerant mixture 19 is dissipated in the evaporator coil 54*a*'. The ice melts, and the water is collected and directed down the drain line 59*a*'. The condensed oil-bearing refrigerant mixture 19 is pumped back through the dump line 52*a*' by the refrigerant defrost pump 68*a*' to the liquid header 30. The condensed oil-bearing refrigerant mixture 19 is then available to serve as the oil-bearing refrigerant mixture 19 for the other refrigerated cases attached to the liquid header 30.

The defrost circuit 36*a*' can use termination sensors to end the defrost cycle. However, termination sensors are not required because when evaporator 14*a*' is defrosted, the hot oil-bearing refrigerant mixture 19 will no longer condense and will stay in a vapor state. The refrigerant defrost pump 68*a*' cannot pump vapor and this stops the flow of hot oil-bearing refrigerant mixture 19 through the dump line 52*a*' and evaporator 14*a*'. Accordingly, when the flow of hot oil-bearing refrigerant mixture 19 is stopped in this manner, the refrigerated case 22*a*' will not be exposed to unplanned heating due to a faulty control system or a failure of a termination switch.

By connecting to the discharge header 28, a sufficient volume of the hot oil-bearing refrigerant mixture 19 will be available to properly defrost any low temperature evaporators in the refrigeration system 10. With multiple evaporators connected to one discharge header 28, the hot oil-bearing refrigerant mixture 19 is readily available. The discharge header 28 can also supply the hot oil-bearing refrigerant mixture 19 for the heat reclaim unit 58 (FIG. 3) or hot water systems and/or reheat coils for humidity control.

This concept lends itself to meeting the temperature requirements of the food industry. The system 10 uses an evaporator and compressor located at individual refrigerated cases and connected to a common high side. The amount of Freon or other refrigerant used per store would reduce from 30% to 40% as well as the monthly consumption. Hot gas system Freon leaks, created by the expansion and contraction of the copper piping, also will be reduced. Both factors are a result of reducing the use of copper pipe. Equipment installation cost may be reduced 35% due to the elimination of the equipment room. Electrical installation costs will be reduced as well.

Independently cooled refrigerated cases according to the present invention will also significantly reduce food loss. For example, compressor failures will be isolated per refrigerated case compared to the failure of an entire section of refrigerated cases in a current supermarket refrigeration system. The compressor size differential liability is reduced on maintenance and servicing of the equipment. Finding and training qualified service technicians will become easier due to the systems simplicity.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A supermarket refrigeration system comprising:

a plurality of supermarket refrigeration cases for containing refrigerated goods therein;

each supermarket refrigeration case comprising an evaporator and an associated compressor connected downstream therefrom;

a common condenser connected downstream from said compressors;

a receiver connected downstream from said common condenser and upstream from said evaporators;

a liquid header extending throughout a supermarket and connecting said receiver and said evaporators;

a discharge header extending throughout the supermarket and connecting said compressors to said common condenser; and an oil-bearing refrigerant mixture circulating through a refrigerant circulation path defined by said evaporators, compressors, common condenser, receiver, liquid header and discharge header;

said oil-bearing refrigerant mixture lubricating said compressors without undesired pooling and without an oil separator in the refrigerant circulation path.

2. The supermarket refrigeration system according to claim 1 wherein said common condenser is located external from the supermarket.

3. The supermarket refrigeration system according to claim 1 wherein each evaporator and associated compressor have matched capacities.

4. The supermarket refrigeration system according to claim 1 wherein each supermarket refrigeration case further comprises an insulated enclosure surrounding said compressor.

5. The supermarket refrigeration system according to claim 1 further comprising at least one unused expansion drop connection along at least one of said liquid header and said discharge header.

6. The supermarket refrigeration system according to claim 1 wherein each supermarket refrigeration case further comprises a selectively operable defrost circuit to use hot oil-bearing refrigerant mixture for defrosting.

7. The supermarket refrigeration system according to claim 6 wherein each refrigeration case further comprises a refrigerant defrost pump connected between said evaporator and said liquid header and selectively operable with said defrost circuit.

8. The supermarket refrigeration system according to claim 1 wherein said common condenser comprises a condenser heat exchanger and a plurality of selectively operable condenser fans associated therewith.

9. The supermarket refrigeration system according to claim 1 wherein said liquid header and said discharge header each comprises copper lines.

10. The supermarket refrigeration system according to claim 1 further comprising an expansion valve upstream from said evaporator.

11. A method for operating a supermarket refrigeration system comprising a plurality of supermarket refrigeration cases each comprising an evaporator and an associated compressor connected downstream therefrom, a common condenser connected downstream from the compressors, a receiver connected downstream from the common condenser and upstream from the evaporators, a liquid header extending throughout a supermarket and connecting the receiver and the evaporators, and a discharge header extending throughout the supermarket and connecting the compressors to the common condenser, the method comprising;

circulating an oil-bearing refrigerant mixture through a refrigerant circulation path defined by the evaporators, compressors, common condenser, receiver, liquid header and discharge header so that the oil-bearing refrigerant mixture lubricates the compressors without undesired, pooling and without an oil separator in the refrigerant circulation path.

12. The method according to claim 11 wherein the common condenser is located external from the supermarket.

13. The method according to claim 11 wherein each evaporator and associated compressor have matched capacities.

14. The method according to claim 11 further comprising surrounding each compressor with an insulated enclosure.

15. The method according to claim 11 further comprising providing at least one unused expansion drop connections along at least one of the liquid header and the discharge header.

16. The method according to claim 11 wherein each supermarket refrigeration case further comprises a defrost circuit; and further comprising selectively operating the defrost circuit of at least one supermarket refrigeration case to use hot oil-bearing refrigerant mixture for defrosting thereof.

17. The method according to claim 16 wherein each refrigeration case further comprises a refrigerant defrost pump connected between the evaporator and the liquid header; and further comprising selectively operating. the refrigerant defrost pump with the defrost circuit.

18. The method according to claim 11 wherein the common condenser comprises a condenser heat exchanger and a plurality of selectively operable condenser fans associated therewith.

* * * * *